US010417968B2

(12) United States Patent
Wang

(10) Patent No.: US 10,417,968 B2
(45) Date of Patent: Sep. 17, 2019

(54) AMOLED DISPLAY AND DRIVING METHOD THEREOF

(71) Applicant: Shenzhen China Star Optoelectronics Semiconductor Display Technology Co., Ltd., Shenzhen (CN)

(72) Inventor: Limin Wang, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 24 days.

(21) Appl. No.: 15/744,073

(22) PCT Filed: Dec. 14, 2017

(86) PCT No.: PCT/CN2017/116288

§ 371 (c)(1),
(2) Date: Jan. 12, 2018

(87) PCT Pub. No.: WO2019/095483

PCT Pub. Date: May 23, 2019

(65) Prior Publication Data

US 2019/0156759 A1 May 23, 2019

(30) Foreign Application Priority Data

Nov. 20, 2017 (CN) ..... 2017 1 1159196

(51) Int. Cl.
*G09G 3/3266* (2016.01)
*G09G 3/3258* (2016.01)
*G09G 3/3233* (2016.01)

(52) U.S. Cl.
CPC ..... *G09G 3/3266* (2013.01); *G09G 3/3233* (2013.01); *G09G 3/3258* (2013.01); CPC ..... *G09G 2300/0426* (2013.01); *G09G 2300/0819* (2013.01); *G09G 2300/0861* (2013.01); *G09G 2310/0251* (2013.01); *G09G 2310/0262* (2013.01); *G09G 2310/0297* (2013.01); *G09G 2310/061* (2013.01); *G09G 2320/043* (2013.01)

(58) Field of Classification Search
CPC ..... G09G 3/3266; G09G 3/3258; G09G 2300/0426; G09G 2310/0297; G09G 2310/061
See application file for complete search history.

(56) References Cited

U.S. PATENT DOCUMENTS

2010/0039453 A1* 2/2010 Chaji ..... G09G 3/20 345/690
2017/0110055 A1* 4/2017 Li ..... G09G 3/325

* cited by examiner

*Primary Examiner* — Lisa S Landis
(74) *Attorney, Agent, or Firm* — Leong C. Lei

(57) ABSTRACT

The invention provides an AMOLED display and driving method thereof, wherein a display panel is provided with a plurality of multiplexers, with each multiplexer having a multiplexer control end receiving a multiplexing control signal, a first input end connected to gate driver and a second input end to a constant low voltage. The first and second output ends are respectively connected to the first and second control ends of corresponding rows of sub-pixel driving circuits. When driving AMOLED display, the multiplexer receives scan signal from gate driver, and under control of multiplex control signal, the first and second output ends selectively output scan signal or the constant low voltage, respectively to generate two different control signals respectively outputted to the first and second control ends of corresponding row of sub-pixel driving circuits. The invention can reduce the number of the output channels of gate drivers to reduce production cost.

8 Claims, 5 Drawing Sheets

AMOLED DISPLAY AND DRIVING METHOD THEREOF

BACKGROUND OF THE INVENTION

1. Field of the Invention

The present invention relates to the field of display techniques, and in particular to an active matrix organic light-emitting diode (AMOLED) display and driving method thereof.

2. The Related Arts

The organic light-emitting diode (OLED) display device provides the advantages of self-luminous, low driving voltage, high luminous efficiency, short response time, high definition and contrast, nearly 180° viewing angle, wide temperature range operation, ability to achieve flexibility display and large-area full-color display and many other advantages, and is thus recognized as the most promising display device in the industry.

The OLED display can be classified into passive matrix OLED (PMOLED) and active matrix OLED (AMOLED) according to the driving mode, that is, the direct addressing and the thin film transistor (TFT) array addressing two categories. Among them, AMOLED has a pixel array, is an active display type, high luminous efficiency, and usually used for high-definition large-size display device.

The OLED is a current-driven device. When a current flows through the OLED, the OLED emits light, and the light-emitting brightness is determined by the current flowing through the OLED. Most of the existing integrated circuits (ICs) only transmit voltage signals, so the pixel driving circuit of AMOLED needs to perform the task of converting voltage signals into current signals. Conventional AMOLED pixel driving circuit is usually of 2T1C structure, that is, the structure of two TFTs plus a capacitor. The voltage is transformed into a current flowing through the OLED, the current value of the current flowing through the OLED is related to the threshold voltage of driving TFT of the two TFTs. As the threshold voltage of the driving TFT shifts, the display uniformity of the AMOLED display decreases. To solve this problem, the AMOLED display needs to be compensated.

Refer to FIG. 1, which is a schematic view of the structure of an existing AMOLED display device. The AMOLED display device comprises a plurality of sub-pixel driving circuits 100' arranged in an array and a gate driver 200' electrically connected with the sub-pixel driving circuit 100'. The AMOLED display has two gate lines 300' corresponding to each row of sub-pixel driving circuit 100'. The two gate lines 300' are respectively electrically connected to a corresponding row of sub-pixel driving circuits 100'. The gate driver 200' is provided with an output channel electrically connected to the gate line 300' corresponding to each of the gate lines 300'. In operation, the gate driver 200' provides a first control signal S1' and a second control signal S2' to each row of sub-pixel driving circuits 100' through the corresponding gate line 300' to achieve performing compensation on the threshold voltage of the driving TFTs of the sub-pixel driving circuits 100' while driving a plurality of rows of sub-pixel driving circuits. As the resolution of the AMOLED display increases, the number of rows in the sub-pixel driving circuit 100' increases significantly, and the number of output channels of the gate driver 200' also increases significantly. The number of the output channels of the gate driver 200' is limited, which requires increasing the number of gate drivers 200', resulting in increased product costs.

SUMMARY OF THE INVENTION

The object of the present invention is to provide an AMOLED display, which is able to reduce the number of the output channels of the gate drivers to reduce the production cost.

Another object of the present invention is to provide a driving method of AMOLED display, which is easy to operate and able to reduce the number of the output channels of the gate drivers to reduce the production cost.

To achieve the above object, the present invention provides an AMOLED display, which comprises: a display panel and a gate driver electrically connected to the display panel;

the display panel comprising: a plurality of sub-pixel driving circuits arranged in an array, and a plurality of multiplexers corresponding to the plurality of rows of sub-pixel driving circuits; each multiplexer having a control end connected to a multiplexing control signal, a first input end electrically connected to the gate driver, a second input end connected to a constant low voltage, a first output end connected to a first control end corresponding to a row of sub-pixel driving circuits, and a second output connected to a second control end corresponding to a row of sub-pixel driving circuits;

the gate driver being for outputting scan signals to the first ends of the plurality of multiplexers; the multiplexers being for receiving scan signals, and under the control of the multiplexing control signal, making the first output end selectively outputting the scan signal or constant low voltage and making the second output end selectively outputting the constant low voltage or scan signal.

According to a preferred embodiment of the present invention, when the multiplexing control signal is at high voltage, the first output end outputs the scan signal and the second output end outputs the constant low voltage; when the multiplexing control signal is at low voltage, the first output end outputs the constant low voltage and the second output end outputs the scan signal.

According to a preferred embodiment of the present invention, the scan signal and the multiplexing control signal are combined to correspond to a reset phase, a sensing phase, a data-writing phase, and a light-emitting phase sequentially;

in the reset phase, the scan signal from the gate driver is first at high voltage and then becomes low voltage, the multiplexing control signal is at high voltage, the first output end outputs a high voltage and then a low voltage, and the second output end outputs the constant low voltage;

in the sensing phase, the scan signal from the gate driver is at high voltage, the multiplexing control signal is at low voltage, the first output end outputs the constant low voltage, and the second output end outputs a high voltage;

in the data-writing phase, the scan signal from the gate driver is at high voltage, the multiplexing control signal is at low voltage, the first output end outputs the constant low voltage, and the second output end outputs a high voltage;

in the light-emitting phase, the scan signal from the gate driver is at low voltage, the multiplexing control signal is at high voltage, the first output end outputs a low voltage, and the second output end outputs the constant low voltage.

According to a preferred embodiment of the present invention, the gate driver is connected to receive a gate output control signal, the gate output control signal is a pulse signal, and the scan signal outputted from the gate driver at the low voltage in the reset phase has a duration equal to a duration of the gate output control signal at high voltage in a cycle.

According to a preferred embodiment of the present invention, each sub-pixel driving circuit comprises: a first TFT, a second TFT, a third TFT, a fourth TFT, a capacitor, and an OLED; the first TFT having a gate as the second control end of the sub-pixel driving circuit, a source receiving a data signal, and a drain electrically connected to a gate of the second TFT; the second TFT having a drain receiving a power source voltage, and a source electrically connected to an anode of the OLED; the third TFT having a gate as the first control end of the sub-pixel driving circuit, a drain electrically connected to the gate of the second TFT, and a source electrically connected to a source of the fourth TFT, the fourth TFT having a gate electrically connected to the gate of the third TFT, a source receiving an initialization voltage, and a drain electrically connected to the anode of the OLED; the capacitor having two ends electrically connected respectively to the gate and the source of the second TFT; and the OLED having a cathode connected to ground.

According to a preferred embodiment of the present invention, in the reset phase and the sensing phase, the data signal is a reference voltage, and in the data-writing phase and light-emitting phase, the data signal is a signal voltage.

According to a preferred embodiment of the present invention, the display panel comprises an active area and a non-active area disposed outside of the active area; the plurality of sub-pixel driving circuits are in the active area and the plurality of multiplexers are in the non-active area.

The present invention also provides a driving method of AMOLED display, applicable to the above AMOLED display, which comprises:

Step S1: entering reset phase;

the scan signal from the gate driver is first at high voltage and then becomes low voltage, the multiplexing control signal is at high voltage, the first output end outputs a high voltage and then a low voltage, and the second output end outputs the constant low voltage;

Step S2: entering sensing phase;

the scan signal from the gate driver is at high voltage, the multiplexing control signal is at low voltage, the first output end outputs the constant low voltage, and the second output end outputs a high voltage;

Step S3: entering data-writing phase;

the scan signal from the gate driver is at high voltage, the multiplexing control signal is at low voltage, the first output end outputs the constant low voltage, and the second output end outputs a high voltage;

Step S4: entering light-emitting phase;

the scan signal from the gate driver is at low voltage, the multiplexing control signal is at high voltage, the first output end outputs a low voltage, and the second output end outputs the constant low voltage.

The present invention also provides an AMOLED display, which comprises: a display panel and a gate driver electrically connected to the display panel;

the display panel comprising: a plurality of sub-pixel driving circuits arranged in an array, and a plurality of multiplexers corresponding to the plurality of rows of sub-pixel driving circuits; each multiplexer having a control end connected to a multiplexing control signal, a first input end electrically connected to the gate driver, a second input end connected to a constant low voltage, a first output end connected to a first control end corresponding to a row of sub-pixel driving circuits, and a second output connected to a second control end corresponding to a row of sub-pixel driving circuits;

the gate driver being for outputting scan signals to the first ends of the plurality of multiplexers; the multiplexers being for receiving scan signals, and under the control of the multiplexing control signal, making the first output end selectively outputting the scan signal or constant low voltage and making the second output end selectively outputting the constant low voltage or scan signal.

wherein when the multiplexing control signal being at high voltage, the first output end outputting the scan signal and the second output end outputting the constant low voltage; when the multiplexing control signal being at low voltage, the first output end outputting the constant low voltage and the second output end outputting the scan signal;

wherein the scan signal and the multiplexing control signal being combined to correspond to a reset phase, a sensing phase, a data-writing phase, and a light-emitting phase sequentially;

in the reset phase, the scan signal from the gate driver being first at high voltage and then becoming low voltage, the multiplexing control signal being at high voltage, the first output end outputting a high voltage and then a low voltage, and the second output end outputting the constant low voltage;

in the sensing phase, the scan signal from the gate driver being at high voltage, the multiplexing control signal being at low voltage, the first output end outputting the constant low voltage, and the second output end outputting a high voltage;

in the data-writing phase, the scan signal from the gate driver being at high voltage, the multiplexing control signal being at low voltage, the first output end outputting the constant low voltage, and the second output end outputting a high voltage;

in the light-emitting phase, the scan signal from the gate driver being at low voltage, the multiplexing control signal being at high voltage, the first output end outputting a low voltage, and the second output end outputting the constant low voltage;

wherein the gate driver being connected to receive a gate output control signal, the gate output control signal being a pulse signal, and the scan signal outputted from the gate driver at the low voltage in the reset phase having a duration equal to a duration of the gate output control signal at high voltage in a cycle.

wherein each sub-pixel driving circuit comprising: a first TFT, a second TFT, a third TFT, a fourth TFT, a capacitor, and an OLED; the first TFT having a gate as the second control end of the sub-pixel driving circuit, a source receiving a data signal, and a drain electrically connected to a gate of the second TFT; the second TFT having a drain receiving a power source voltage, and a source electrically connected to an anode of the OLED; the third TFT having a gate as the first control end of the sub-pixel driving circuit, a drain electrically connected to the gate of the second TFT, and a source electrically connected to a source of the fourth TFT, the fourth TFT having a gate electrically connected to the gate of the third TFT, a source receiving an initialization voltage, and a drain electrically connected to the anode of the OLED; the capacitor having two ends electrically connected respectively to the gate and the source of the second TFT; and the OLED having a cathode connected to ground.

The present invention provides the following advantages: the invention provides an AMOLED display, wherein a display panel is provided with a plurality of multiplexers, each multiplexer has a multiplexer control end connected to receive a multiplexing control signal, a first input end electrically connected to the gate driver and a second input end to a constant low voltage. The first output end and the second output end are respectively connected to the first control end and the second control end of the corresponding rows of sub-pixel driving circuits. When the AMOLED display is driven, the multiplexer receives the scan signal from the gate driver, and under the control of the multiplex control signal, the first output end selectively outputs the scan signal or the constant low voltage, and the second output end selectively outputs the constant low voltage or the scan signal to generate two different control signals respectively outputted to the first control end and the second control end of the corresponding row of sub-pixel driving circuits. As such, the invention can effectively reduce the number of the output channels of the gate drivers to reduce the production cost. The invention also provides a driving method of AMOLED display, which is easy to operate and able to reduce the number of the output channels of the gate drivers to reduce the production cost.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
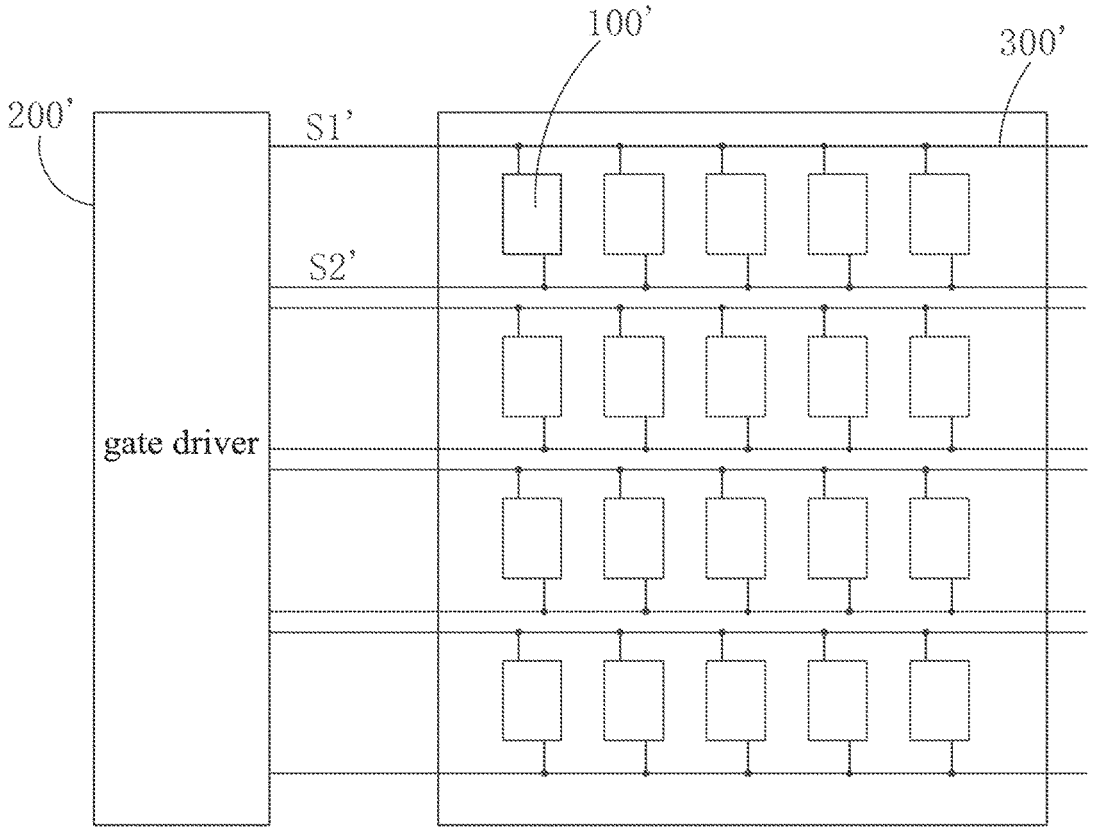
Fig. 1 Prior Art
FIG. 1 is a schematic view showing the structure of a conventional AMOLED display.
Figure 2:
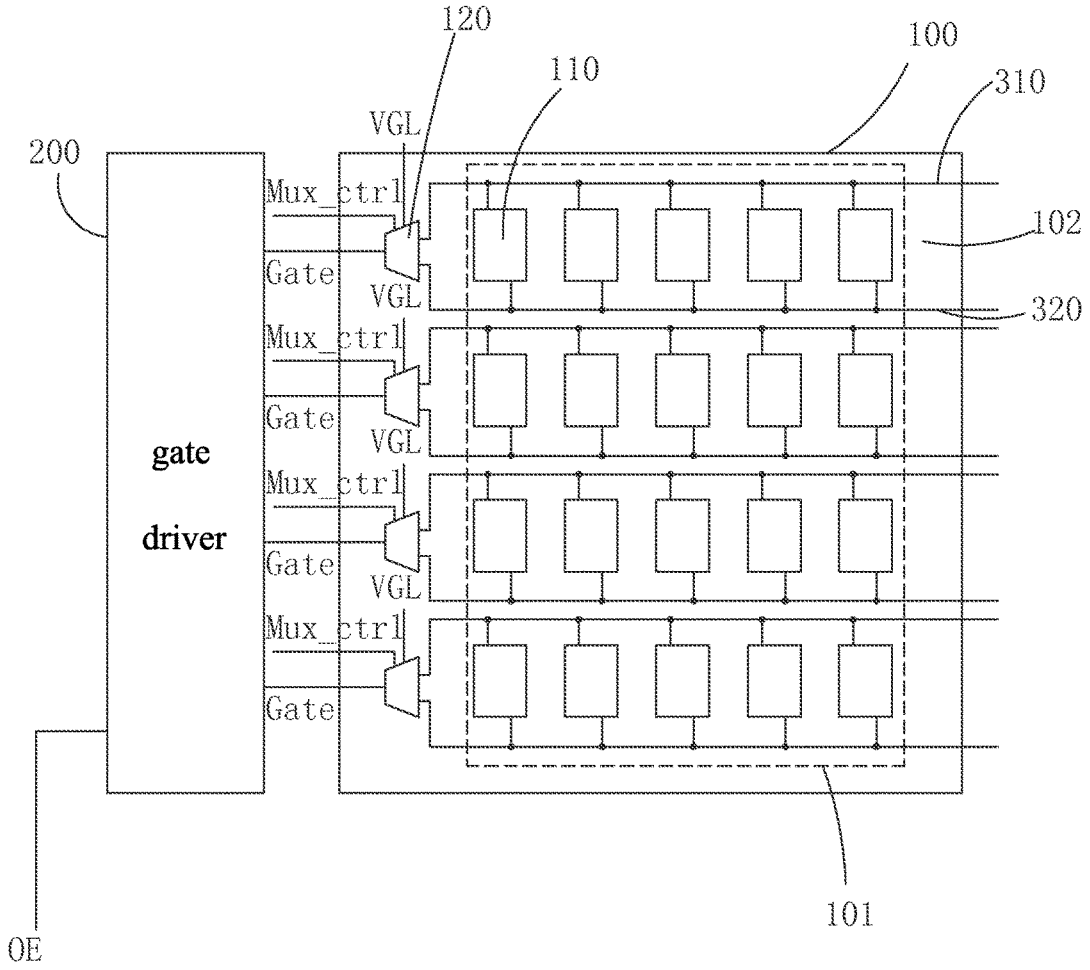
FIG. 2 is a schematic view showing the structure of AMOLED display according to a preferred embodiment of the present invention.
Figure 3:
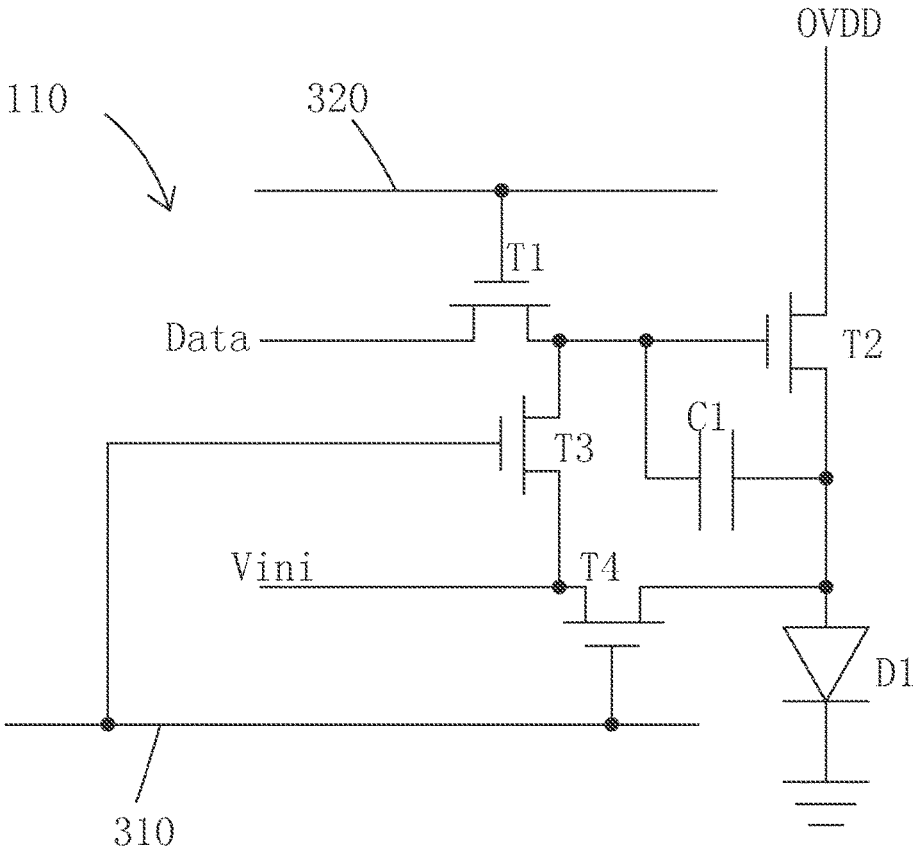
FIG. 3 is a schematic view showing the sub-pixel driving circuit of AMOLED display according to a preferred embodiment of the present invention.
Figure 4:
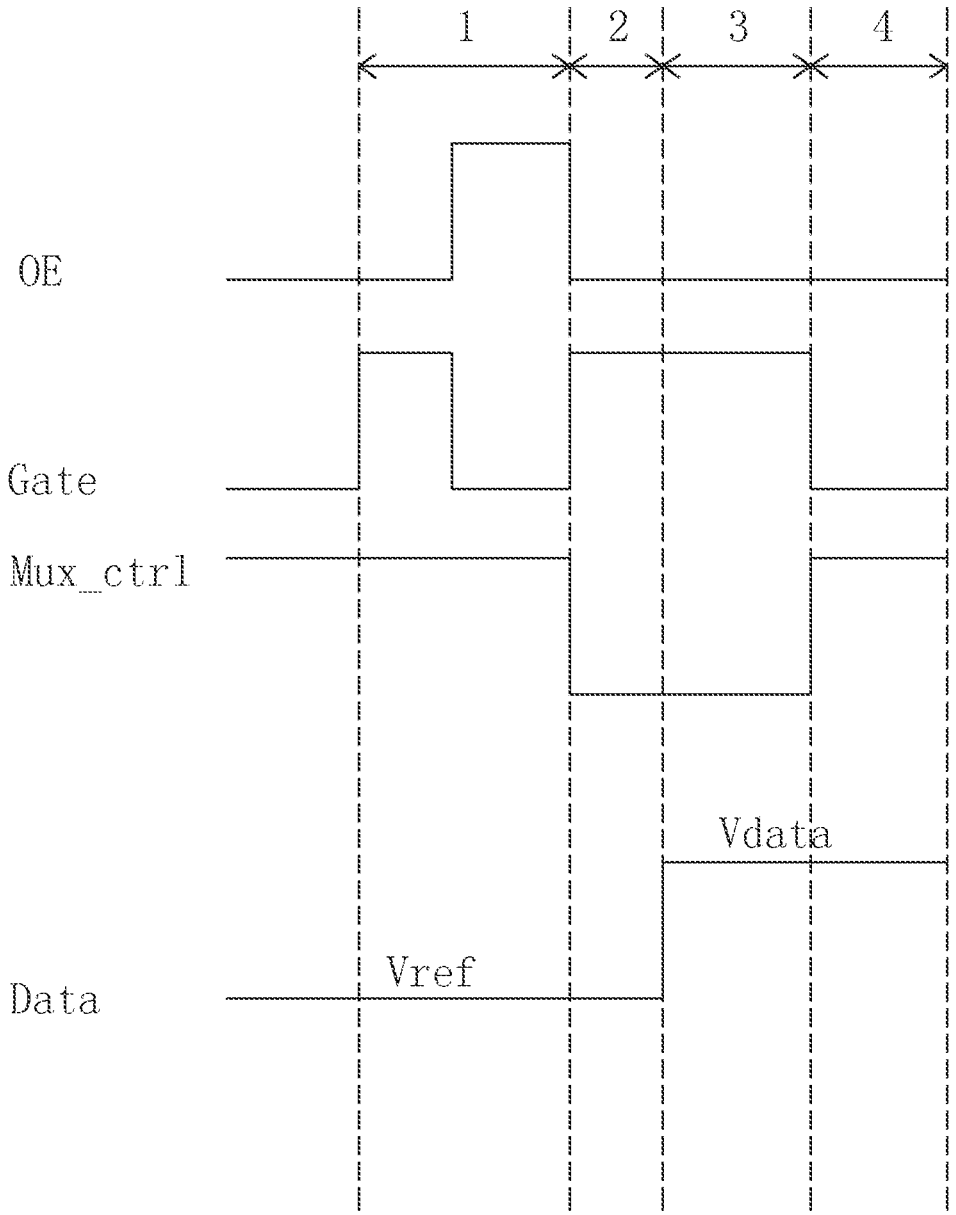
FIG. 4 is a schematic view showing the timing diagram of AMOLED display according to a preferred embodiment of the present invention.

Referring to FIG. 2 and FIG. 3, the present invention provides an AMOLED display, which comprises: a display panel 100 and a gate driver 200 electrically connected to the display panel 100;

the display panel 100 comprising: a plurality of sub-pixel driving circuits 110 arranged in an array, and a plurality of multiplexers 120 corresponding to the plurality of rows of sub-pixel driving circuits 110; each multiplexer 120 having a control end connected to a multiplexing control signal Mux_ctrl, a first input end electrically connected to the gate driver 200, a second input end connected to a constant low voltage VGL, a first output end connected to a first control end corresponding to a row of sub-pixel driving circuits 110, and a second output connected to a second control end corresponding to a row of sub-pixel driving circuits 110.

Specifically, the AMOLED display disposes a first scan line 310 and a second scan line 320 corresponding to each row of sub-pixel driving circuits 110. The first output end of each multiplexer 120 is connected to the first control end of the corresponding row of sub-pixel driving circuits 110 through the first scan line 310, and the second output end is connected to the second control end of the corresponding row of sub-pixel driving circuits 110 through the second scan line 320.

Specifically, the display panel 100 comprises an active area 101 and a non-active area 102 disposed outside of the active area 101; the plurality of sub-pixel driving circuits 110 are in the active area 101 and the plurality of multiplexers 120 are in the non-active area 102.

Specifically, each sub-pixel driving circuit 110 has a 4T1C structure and comprises: a first TFT T1, a second TFT T2, a third TFT T3, a fourth TFT T4, a capacitor C1, and an OLED D1; the first TFT T1 having a gate as the second control end of the sub-pixel driving circuit 110, a source receiving a data signal Data, and a drain electrically connected to a gate of the second TFT T2; the second TFT T2 having a drain receiving a power source voltage OVDD, and a source electrically connected to an anode of the OLED D1; the third TFT T3 having a gate as the first control end of the sub-pixel driving circuit 110, a drain electrically connected to the gate of the second TFT T2, and a source electrically connected to a source of the fourth TFT T4, the fourth TFT T4 having a gate electrically connected to the gate of the third TFT T3, a source receiving an initialization voltage Vini, and a drain electrically connected to the anode of the OLED D1; the capacitor C1 having two ends electrically connected respectively to the gate and the source of the second TFT T2; and the OLED D1 having a cathode connected to ground. The second TFT is the driving TFT.

It should be noted that the gate driver 200 is for outputting scan signals Gate to the first ends of the plurality of multiplexers 120; the multiplexers 120 are for receiving scan signals Gate, and under the control of the multiplexing control signal Mux_ctrl, making the first output end selectively outputting the scan signal Gate or constant low voltage VGL and making the second output end selectively outputting the constant low voltage VGL or scan signal Gate.

Specifically, when the multiplexing control signal Mux_ctrl is at high voltage, the first output end outputs the scan signal Gate and the second output end outputs the constant low voltage VGL; when the multiplexing control signal Mux_ctrl is at low voltage, the first output end outputs the constant low voltage VGL and the second output end outputs the scan signal Gate.

Figure 5:
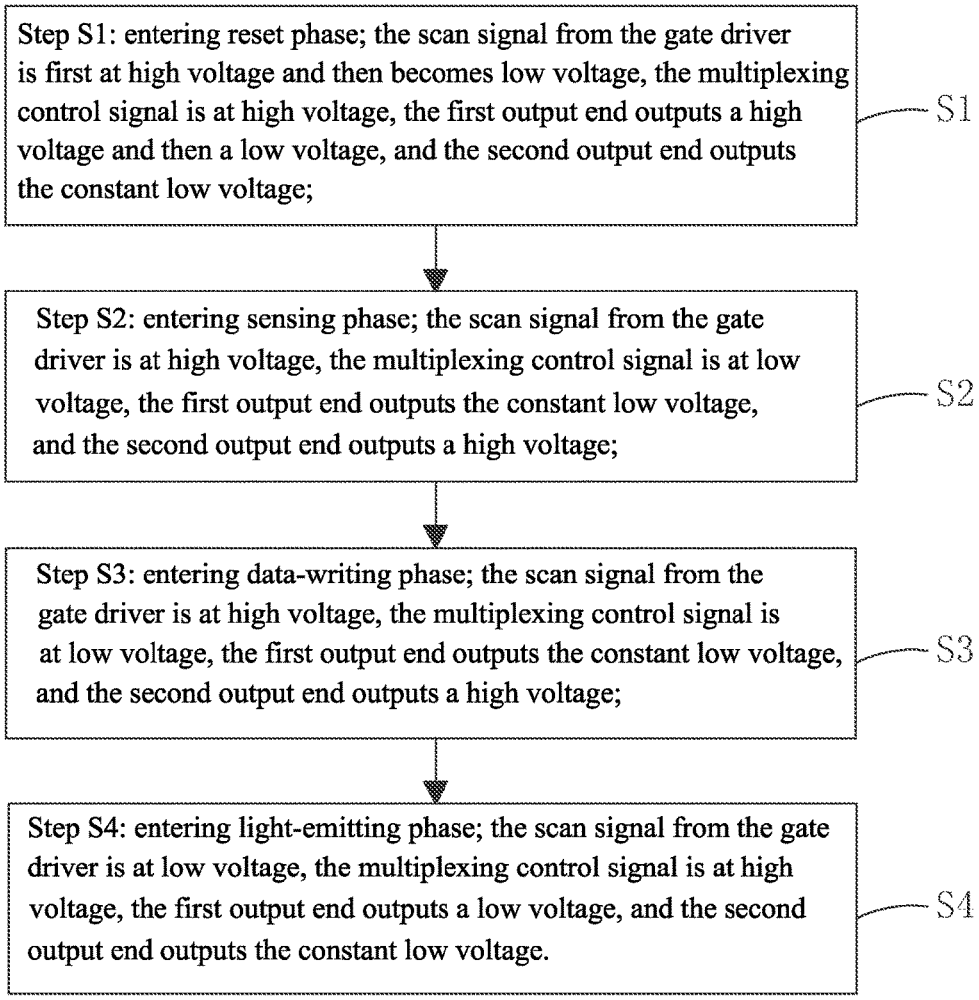
FIG. 5 is a schematic view showing a flowchart of the driving method of AMOLED display according to a preferred embodiment of the present invention.

Moreover, refer to FIG. 5. The scan signal Gate and the multiplexing control signal Mux_ctrl are combined to correspond to a reset phase 1, a sensing phase 2, a data-writing phase 3, and a light-emitting 4 phase sequentially;

in the reset phase 1, the scan signal Gate from the gate driver 200 is first at high voltage and then becomes low voltage, the multiplexing control signal Mux_ctrl is at high voltage, the first output end outputs a high voltage and then a low voltage, and the second output end outputs the constant low voltage VGL; the third TFT T3 and the fourth TFT T4 are conductive when the first output end of the multiplexer 120 outputs a high voltage, and the second TFT T2 is cut off due to the control of the constant low voltage VGL outputted by the second output end of the multiplexer 120; the initialization voltage Vini is written to the two ends of the capacitor C1 through the conductive third TFT T3 and the fourth TFT T4 to accomplish resetting the gate voltage and source voltage of the second TFT T2;

in the sensing phase 2, the scan signal Gate from the gate driver 200 is at high voltage, the multiplexing control signal Mux_ctrl is at low voltage, the first output end outputs the constant low voltage VGL, and the second output end outputs a high voltage; the first TFT T1 is conductive due to the control of the high voltage outputted by the second output end of the multiplexer 120, and the third TFT T3 and the fourth TFT T4 are cut off due to the control of the constant low voltage VGL outputted by the first output end of the multiplexer 120; the Data signal is a reference voltage Vref and is written into the gate of the second TFT T2, the power source voltage OVDD charges the source of the second TFT T2 until the voltage at the source of the second TFT T2 reaches Vref−Vth, wherein Vth is the threshold voltage of the second TFT T2 to accomplish the sensing of the threshold voltage of the second TFT T2;

in the data-writing phase 3, the scan signal Gate from the gate driver 200 is at high voltage, the multiplexing control signal Mux_crtl is at low voltage, the first output end outputs the constant low voltage VGL, and the second output end outputs a high voltage; the first TFT T1 stays conductive, and the third TFT T3 and the fourth TFT T4 stay cut off; the Data signal is a data signal Vdata and is written into the gate of the second TFT T2, the source voltage of the second TFT T2 is Vref−Vth+ΔV, wherein ΔV is the source voltage change of the second TFT T2 in the data-writing phase 3, and is related to the signal voltage Vdata;

in the light-emitting phase 4, the scan signal Gate from the gate driver 200 is at low voltage, the multiplexing control signal Mux_ctrl is at high voltage, the first output end outputs a low voltage, and the second output end outputs the constant low voltage VGL; the first TFT T1 is cut off due to the control of the constant low voltage VGL outputted by the second output end of the multiplexer 120, the third TFT T3 and the fourth TFT T4 are cut off due to the control of the low voltage outputted by the first output end of the multiplexer 120; due to the storage effect of the capacitor C1, the gate voltage of the second TFT T2 is maintained at Vref−Vth+ΔV, and the OLED D1 emits light.

It should be noted that, based on the equation of the current flowing through the OLED:

$$I=k(V\text{gs}-V\text{th})^2;$$

Wherein I is the current flowing through the OLED D1, k is the intrinsic conductivity factor of the second TFT T2, i.e., the driving TFT, Vgs is the voltage different between the gate and the source of the second TFT T2, Vth is the threshold voltage of the second TFT T2, i.e., the driving TFT, the following equation is obtained by substituting the voltage different between the gate and the source of the second TFT T2 into the above equation:

$$I=k(V\text{gs}-V\text{th})^2=(V\text{data}-V\text{ref}+V\text{th}-\Delta V-V\text{th})^2=(V\text{data}-V\text{ref}-\Delta V)^2;$$

As shown, the current flowing through the OLED D1 is independent of the threshold voltage of the second TFT T2 and the threshold voltage of the second TFT T2 is compensated. Meanwhile, the present invention provides a plurality of multiplexers 120, with each multiplexer 120 having a multiplexer control end connected to receive a multiplexing control signal Mux_ctrl, a first input end electrically connected to the gate driver 200 and a second input end to a constant low voltage VGL. The first output end and the second output end are respectively connected to the first control end and the second control end of the corresponding rows of sub-pixel driving circuits 110. When the AMOLED display is driven, the multiplexer 120 receives the scan signal Gate from the gate driver 200, and under the control of the multiplex control signal Mux_ctrl, the first output end selectively outputs the scan signal Gate or the constant low voltage VGL, and the second output end selectively outputs the constant low voltage VGL or the scan signal Gate to generate two different control signals respectively outputted to the first control end and the second control end of the corresponding row of sub-pixel driving circuits 110. Compared to the known technique wherein the required output channels is two times of the rows of the sub-pixel driving circuits for the gate driver, the invention can effectively reduce the number of the output channels of the gate drivers by half and to reduce the production cost when applied to high resolution design.

Moreover, the gate driver 200 of the present invention is connected to the gate output control signal OE for controlling the waveform of the outputted scan signal Gate. The gate output control signal OE is a pulse signal. Under the control of the gate output control signal OE, the duration of the low voltage of the scan signal Gate outputted by the gate driver 200 during the reset phase 1 corresponds to the high voltage duration of one period of the gate output control signal OE; that is, when the rising edge of the gate output control signal OE arrives, the first falling edge of the scan signal Gate arrives; when the falling edge of the gate output control signal OE arrives, the second rising edge of the scan signal Gate arrives. As such, the low voltage duration of the scan signal Gate in the reset phase 1 by adjusting the high voltage duration of the gate output control signal OE, so as to adjust the time interval of the high voltage output between the first output end and the second output end of the multiplexer 120 to satisfy the demands of the timing sequence design.

Refer to FIG. 6. The present invention also provides a driving method of AMOLED display, applicable to the above AMOLED display, wherein the details of the AMOLED display are not repeated here. The driving method of AMOLED display comprises:

Step S1: entering reset phase 1;

the scan signal Gate from the gate driver 200 is first at high voltage and then becomes low voltage, the multiplexing control signal Mux_ctrl is at high voltage, the first output end outputs a high voltage and then a low voltage, and the second output end outputs the constant low voltage VGL; the third TFT T3 and the fourth TFT T4 are conductive when the first output end of the multiplexer 120 outputs a high voltage, and the second TFT T2 is cut off due to the control of the constant low voltage VGL outputted by the second output end of the multiplexer 120; the initialization voltage Vini is written to the two ends of the capacitor C1 through the conductive third TFT T3 and the fourth TFT T4 to accomplish resetting the gate voltage and source voltage of the second TFT T2;

Step S2: entering sensing phase 2;

the scan signal Gate from the gate driver 200 is at high voltage, the multiplexing control signal Mux_ctrl is at low voltage, the first output end outputs the constant low voltage VGL, and the second output end outputs a high voltage; the first TFT T1 is conductive due to the control of the high voltage outputted by the second output end of the multiplexer 120, and the third TFT T3 and the fourth TFT T4 are cut off due to the control of the constant low voltage VGL outputted by the first output end of the multiplexer 120; the Data signal is a reference voltage Vref and is written into the gate of the second TFT T2, the power source voltage OVDD charges the source of the second TFT T2 until the voltage at the source of the second TFT T2 reaches Vref−Vth, wherein Vth is the threshold voltage of the second TFT T2 to accomplish the sensing of the threshold voltage of the second TFT T2;

Step S3: entering data-writing phase 3;

the scan signal Gate from the gate driver 200 is at high voltage, the multiplexing control signal Mux_crtl is at low voltage, the first output end outputs the constant low voltage VGL, and the second output end outputs a high voltage; the first TFT T1 stays conductive, and the third TFT T3 and the fourth TFT T4 stay cut off; the Data signal is a data signal Vdata and is written into the gate of the second TFT T2, the source voltage of the second TFT T2 is Vref−Vth+ΔV, wherein ΔV is the source voltage change of the second TFT T2 in the data-writing phase 3, and is related to the signal voltage Vdata;

Step S4: entering light-emitting phase 4;

the scan signal Gate from the gate driver 200 is at low voltage, the multiplexing control signal Mux_ctrl is at high voltage, the first output end outputs a low voltage, and the second output end outputs the constant low voltage VGL; the first TFT T1 is cut off due to the control of the constant low voltage VGL outputted by the second output end of the multiplexer 120, the third TFT T3 and the fourth TFT T4 are cut off due to the control of the low voltage outputted by the first output end of the multiplexer 120; due to the storage effect of the capacitor C1, the gate voltage of the second TFT T2 is maintained at Vref−Vth+ΔV, and the OLED D1 emits light.

It should be noted that, based on the equation of the current flowing through the OLED:

$$I=k(V\text{gs}-V\text{th})^2;$$

Wherein I is the current flowing through the OLED D1, k is the intrinsic conductivity factor of the second TFT T2, i.e., the driving TFT, Vgs is the voltage different between the gate and the source of the second TFT T2, Vth is the threshold voltage of the second TFT T2, i.e., the driving TFT, the following equation is obtained by substituting the voltage different between the gate and the source of the second TFT T2 into the above equation:

$$I=k(V\text{gs}-V\text{th})^2=(V\text{data}-V\text{ref}+V\text{th}-\Delta V-V\text{th})^2=(V\text{data}-V\text{ref}-\Delta V)^2;$$

As shown, the current flowing through the OLED D1 is independent of the threshold voltage of the second TFT T2 and the threshold voltage of the second TFT T2 is compensated. Meanwhile, the present invention provides a plurality of multiplexers 120, with each multiplexer 120 having a multiplexer control end connected to receive a multiplexing control signal Mux_ctrl, a first input end electrically connected to the gate driver 200 and a second input end to a constant low voltage VGL. The first output end and the second output end are respectively connected to the first control end and the second control end of the corresponding rows of sub-pixel driving circuits 110. When the AMOLED display is driven, the multiplexer 120 receives the scan signal Gate from the gate driver 200, and under the control of the multiplex control signal Mux_ctrl, the first output end selectively outputs the scan signal Gate or the constant low voltage VGL, and the second output end selectively outputs the constant low voltage VGL or the scan signal Gate to generate two different control signals respectively outputted to the first control end and the second control end of the corresponding row of sub-pixel driving circuits 110. Compared to the known technique wherein the required output channels is two times of the rows of the sub-pixel driving circuits for the gate driver, the invention can effectively reduce the number of the output channels of the gate drivers by half and to reduce the production cost when applied to high resolution design.

Moreover, the gate driver 200 of the present invention is connected to the gate output control signal OE for controlling the waveform of the outputted scan signal Gate. The gate output control signal OE is a pulse signal. Under the control of the gate output control signal OE, the duration of the low voltage of the scan signal Gate outputted by the gate driver 200 during the reset phase 1 corresponds to the high voltage duration of one period of the gate output control signal OE; that is, when the rising edge of the gate output control signal OE arrives, the first falling edge of the scan signal Gate arrives; when the falling edge of the gate output control signal OE arrives, the second rising edge of the scan signal Gate arrives. As such, the low voltage duration of the scan signal Gate in the reset phase 1 by adjusting the high voltage duration of the gate output control signal OE, so as to adjust the time interval of the high voltage output between the first output end and the second output end of the multiplexer 120 to satisfy the demands of the timing sequence design.

In summary, the invention provides an AMOLED display, wherein a display panel is provided with a plurality of multiplexers, each multiplexer has a multiplexer control end connected to receive a multiplexing control signal, a first input end electrically connected to the gate driver and a second input end to a constant low voltage. The first output end and the second output end are respectively connected to the first control end and the second control end of the corresponding rows of sub-pixel driving circuits. When the AMOLED display is driven, the multiplexer receives the scan signal from the gate driver, and under the control of the multiplex control signal, the first output end selectively outputs the scan signal or the constant low voltage, and the second output end selectively outputs the constant low voltage or the scan signal to generate two different control signals respectively outputted to the first control end and the second control end of the corresponding row of sub-pixel driving circuits. As such, the invention can effectively reduce the number of the output channels of the gate drivers to reduce the production cost. The invention also provides a driving method of AMOLED display, which is easy to operate and able to reduce the number of the output channels of the gate drivers to reduce the production cost.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. An active matrix organic light-emitting diode (AMOLED) display, which comprises: a display panel and a gate driver electrically connected to the display panel;

the display panel comprising: a plurality of sub-pixel driving circuits arranged in an array, and a plurality of multiplexers corresponding to the plurality of rows of sub-pixel driving circuits; each multiplexer having a control end connected to a multiplexing control signal, a first input end electrically connected to the gate driver, a second input end connected to a constant low voltage, a first output end connected to a first control end corresponding to a row of sub-pixel driving circuits, and a second output connected to a second control end corresponding to a row of sub-pixel driving circuits;

the gate driver being for outputting scan signals to the first ends of the plurality of multiplexers; the multiplexers being for receiving scan signals, and under the control of the multiplexing control signal, making the first output end selectively outputting the scan signal or constant low voltage and making the second output end selectively outputting the constant low voltage or scan signal;

wherein the scan signal and the multiplexing control signal are combined to correspond to a reset phase, a sensing phase, a data-writing phase, and a light-emitting phase sequentially;

in the reset phase, the scan signal from the gate driver is first at high voltage and then becomes low voltage, the multiplexing control signal is at high voltage, the first output end outputs a high voltage and then a low voltage, and the second output end outputs the constant low voltage;

in the sensing phase, the scan signal from the gate driver is at high voltage, the multiplexing control signal is at low voltage, the first output end outputs the constant low voltage, and the second output end outputs a high voltage;

in the data-writing phase, the scan signal from the gate driver is at high voltage, the multiplexing control signal is at low voltage, the first output end outputs the constant low voltage, and the second output end outputs a high voltage;

in the light-emitting phase, the scan signal from the gate driver is at low voltage, the multiplexing control signal is at high voltage, the first output end outputs a low voltage, and the second output end outputs the constant low voltage;

wherein the gate driver is connected to receive a gate output control signal, the gate output control signal is a pulse signal, and the scan signal outputted from the gate driver at the low voltage in the reset phase has a duration equal to a duration of the gate output control signal at high voltage in a cycle.

2. The AMOLED display as claimed in claim 1, wherein when the multiplexing control signal is at high voltage, the first output end outputs the scan signal and the second output end outputs the constant low voltage; when the multiplexing control signal is at low voltage, the first output end outputs the constant low voltage and the second output end outputs the scan signal.

3. The AMOLED display as claimed in claim 1, wherein each sub-pixel driving circuit comprises: a first thin film transistor (TFT), a second TFT, a third TFT, a fourth TFT, a capacitor, and an OLED; the first TFT having a gate as the second control end of the sub-pixel driving circuit, a source receiving a data signal, and a drain electrically connected to a gate of the second TFT; the second TFT having a drain receiving a power source voltage, and a source electrically connected to an anode of the OLED; the third TFT having a gate as the first control end of the sub-pixel driving circuit, a drain electrically connected to the gate of the second TFT, and a source electrically connected to a source of the fourth TFT, the fourth TFT having a gate electrically connected to the gate of the third TFT, a source receiving an initialization voltage, and a drain electrically connected to the anode of the OLED; the capacitor having two ends electrically connected respectively to the gate and the source of the second TFT; and the OLED having a cathode connected to ground.

4. The AMOLED display as claimed in claim 3, wherein in the reset phase and the sensing phase, the data signal is a reference voltage, and in the data-writing phase and light-emitting phase, the data signal is a signal voltage.

5. The AMOLED display as claimed in claim 1, wherein the display panel comprises an active area and a non-active area disposed outside of the active area; the plurality of sub-pixel driving circuits are in the active area and the plurality of multiplexers are in the non-active area.

6. An active matrix organic light-emitting diode (AMOLED) display, which comprises: a display panel and a gate driver electrically connected to the display panel;

the display panel comprising: a plurality of sub-pixel driving circuits arranged in an array, and a plurality of multiplexers corresponding to the plurality of rows of sub-pixel driving circuits; each multiplexer having a control end connected to a multiplexing control signal, a first input end electrically connected to the gate driver, a second input end connected to a constant low voltage, a first output end connected to a first control end corresponding to a row of sub-pixel driving circuits, and a second output connected to a second control end corresponding to a row of sub-pixel driving circuits;

the gate driver being for outputting scan signals to the first ends of the plurality of multiplexers; the multiplexers being for receiving scan signals, and under the control of the multiplexing control signal, making the first output end selectively outputting the scan signal or constant low voltage and making the second output end selectively outputting the constant low voltage or scan signal;

wherein when the multiplexing control signal being at high voltage, the first output end outputting the scan signal and the second output end outputting the constant low voltage; when the multiplexing control signal being at low voltage, the first output end outputting the constant low voltage and the second output end outputting the scan signal;

wherein the scan signal and the multiplexing control signal being combined to correspond to a reset phase, a sensing phase, a data-writing phase, and a light-emitting phase sequentially;

in the reset phase, the scan signal from the gate driver being first at high voltage and then becoming low voltage, the multiplexing control signal being at high voltage, the first output end outputting a high voltage and then a low voltage, and the second output end outputting the constant low voltage;

in the sensing phase, the scan signal from the gate driver being at high voltage, the multiplexing control signal being at low voltage, the first output end outputting the constant low voltage, and the second output end outputting a high voltage;

in the data-writing phase, the scan signal from the gate driver being at high voltage, the multiplexing control signal being at low voltage, the first output end outputting the constant low voltage, and the second output end outputting a high voltage;

in the light-emitting phase, the scan signal from the gate driver being at low voltage, the multiplexing control signal being at high voltage, the first output end outputting a low voltage, and the second output end outputting the constant low voltage;

wherein the gate driver being connected to receive a gate output control signal, the gate output control signal being a pulse signal, and the scan signal outputted from the gate driver at the low voltage in the reset phase having a duration equal to a duration of the gate output control signal at high voltage in a cycle;

wherein each sub-pixel driving circuit comprising: a first thin film transistor (TFT), a second TFT, a third TFT, a fourth TFT, a capacitor, and an OLED; the first TFT having a gate as the second control end of the sub-pixel driving circuit, a source receiving a data signal, and a drain electrically connected to a gate of the second TFT; the second TFT having a drain receiving a power source voltage, and a source electrically connected to an anode of the OLED; the third TFT having a gate as the first control end of the sub-pixel driving circuit, a drain electrically connected to the gate of the second TFT, and a source electrically connected to a source of the fourth TFT, the fourth TFT having a gate electrically connected to the gate of the third TFT, a source receiving an initialization voltage, and a drain electrically connected to the anode of the OLED; the capacitor having two ends electrically connected respectively to the gate and the source of the second TFT; and the OLED having a cathode connected to ground.

7. The AMOLED display as claimed in claim 6, wherein in the reset phase and the sensing phase, the data signal is a reference voltage, and in the data-writing phase and light-emitting phase, the data signal is a signal voltage.

8. The AMOLED display as claimed in claim 6, wherein the display panel comprises an active area and a non-active area disposed outside of the active area; the plurality of sub-pixel driving circuits are in the active area and the plurality of multiplexers are in the non-active area.

* * * * *